US008910421B2

(12) United States Patent
Potter

(10) Patent No.: US 8,910,421 B2
(45) Date of Patent: Dec. 16, 2014

(54) UNDER TRACK GARAGE DOOR SEAL

(71) Applicant: David Potter, Pleasant View, UT (US)

(72) Inventor: David Potter, Pleasant View, UT (US)

( * ) Notice: Subject to any disclaimer, the term of this patent is extended or adjusted under 35 U.S.C. 154(b) by 0 days.

(21) Appl. No.: 14/173,188

(22) Filed: Feb. 5, 2014

(65) Prior Publication Data

US 2014/0150348 A1 Jun. 5, 2014

Related U.S. Application Data

(63) Continuation-in-part of application No. 13/442,676, filed on Apr. 9, 2012, now abandoned.

(51) Int. Cl.
*E06B 7/22* (2006.01)
*E06B 7/24* (2006.01)
*E06B 7/23* (2006.01)

(52) U.S. Cl.
CPC .. *E06B 7/24* (2013.01); *E06B 7/231* (2013.01)
USPC ..... 49/482.1; 49/197; 49/199; 49/475.1; 49/495.1; 49/496.1

(58) Field of Classification Search
CPC ..... E06B 9/582; E06B 7/16; E06B 7/22; E06B 7/24; E06B 7/2305
USPC ..... 49/197, 199, 475.1, 482.1, 505, 495.1, 49/496.1; 160/40, 201, 41
See application file for complete search history.

(56) References Cited

U.S. PATENT DOCUMENTS

| | | | | |
|---|---|---|---|---|
| 3,227,205 | A * | 1/1966 | Crosswell | 160/40 |
| 4,611,429 | A * | 9/1986 | Kanies | 49/70 |
| 4,957,301 | A * | 9/1990 | Clay et al. | 277/345 |
| 5,207,027 | A * | 5/1993 | Larsen | 49/482.1 |
| 5,435,104 | A * | 7/1995 | Dietrich | 49/493.1 |
| 5,784,834 | A * | 7/1998 | Stutzman | 49/475.1 |
| 6,314,683 | B1 * | 11/2001 | Vesa et al. | 49/496.1 |
| 6,374,567 | B1 * | 4/2002 | Mullet | 52/716.1 |
| 6,772,560 | B2 * | 8/2004 | Dischiant et al. | 49/496.1 |
| 6,772,561 | B1 * | 8/2004 | Berger, Jr. | 49/496.1 |

FOREIGN PATENT DOCUMENTS

GB 2142073 A * 1/1985 ..... E06B 7/23

* cited by examiner

*Primary Examiner* — Katherine Mitchell
*Assistant Examiner* — Marcus Menezes
(74) *Attorney, Agent, or Firm* — Kunzler Law Group

(57) ABSTRACT

For sealing a door, a jamb interface with a specified width connects to a jamb interior face of a jamb along a longitudinal axis of the jamb interior face. The jamb interface includes a plurality of fingers with a proximal edge of each of the fingers in the range of 4 to 6.5 centimeters (cm) from an intersection of the jamb interface and a flap. Each finger has a specified finger height in the range of 1 to 1.5 cm. Each finger is separated from adjacent fingers by a specified spacing height in the range of 1 to 1.5 cm.

9 Claims, 8 Drawing Sheets

UNDER TRACK GARAGE DOOR SEAL

CROSS-REFERENCE TO RELATED APPLICATIONS

This is a continuation-in-part application of and claims priority to U.S. patent application Ser. No. 13/442,676 entitled "DOOR SEAL" and filed on Apr. 9, 2012 for David Potter, which is incorporated herein by reference.

BACKGROUND

1. Field

The subject matter disclosed herein relates to garage door seals and more particularly relates to under track garage door seals.

2. Description of the Related Art

Doors are most energy efficient when the space between a door and a jamb or lintel is sealed to prevent air circulation.

BRIEF SUMMARY

An apparatus for sealing a door is disclosed. A jamb interface with a specified width connects to a jamb interior face of a jamb along a longitudinal axis of the jamb interior face. The jamb interface includes a plurality of fingers with a proximal edge of each of the fingers in the range of 4 to 6.5 centimeters (cm) from an intersection of the jamb interface and a flap. Each finger has a specified finger height in the range of 1 to 1.5 cm. Each finger is separated from adjacent fingers by a specified spacing height in the range of 1 to 1.5 cm. A method and system also perform the functions of the apparatus.

BRIEF DESCRIPTION OF THE DRAWINGS

In order that the advantages of the embodiments of the invention will be readily understood, a more particular description of the embodiments briefly described above will be rendered by reference to specific embodiments that are illustrated in the appended drawings. Understanding that these drawings depict only some embodiments and are not therefore to be considered to be limiting of scope, the embodiments will be described and explained with additional specificity and detail through the use of the accompanying drawings, in which.

DETAILED DESCRIPTION OF THE INVENTION

Reference throughout this specification to "one embodiment," "an embodiment," or similar language means that a particular feature, structure, or characteristic described in connection with the embodiment is included in at least one embodiment. Thus, appearances of the phrases "in one embodiment," "in an embodiment," and similar language throughout this specification may, but do not necessarily, all refer to the same embodiment, but mean "one or more but not all embodiments" unless expressly specified otherwise. The terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise.

The schematic flowchart diagrams and/or schematic block diagrams in the Figures illustrate the architecture, functionality, and operation of possible implementations. It should also be noted that, in some alternative implementations, the functions noted in the block may occur out of the order noted in the Figures. For example, two blocks shown in succession may, in fact, be executed substantially concurrently, or the blocks may sometimes be executed in the reverse order, depending upon the functionality involved. Although various arrow types and line types may be employed in the flowchart and/or block diagrams, they are understood not to limit the scope of the corresponding embodiments. Indeed, some arrows or other connectors may be used to indicate only an exemplary logical flow of the depicted embodiment.

The description of elements in each figure may refer to elements of proceeding figures. Like numbers refer to like elements in all figures, including alternate embodiments of like elements.

Figure 1:
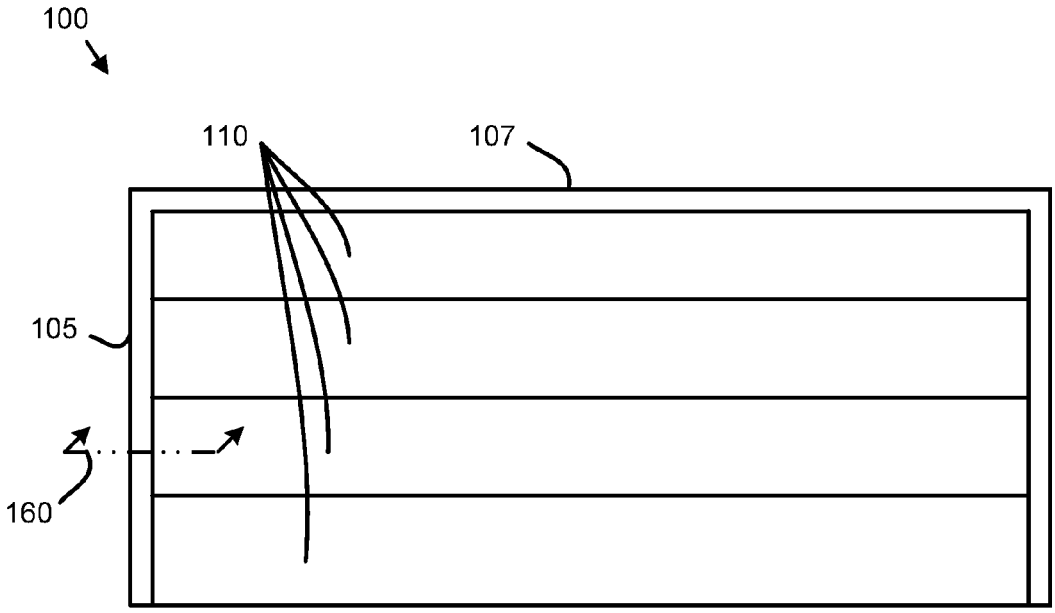
Prior Art FIG. 1
FIG. 1 is a front view drawing illustrating one embodiment of a sectional door.

FIG. 1 is a front view drawing illustrating one embodiment of a sectional door 100. The sectional door 100 may be a garage door. The sectional door 100 includes a plurality of sections 110. A jamb 105 and a lintel 107 may be disposed adjacent the sectionals 110. A cross section 160 of the sectional door 100 is depicted in FIGS. 2A-B and 3A-B.

Figure 2A:
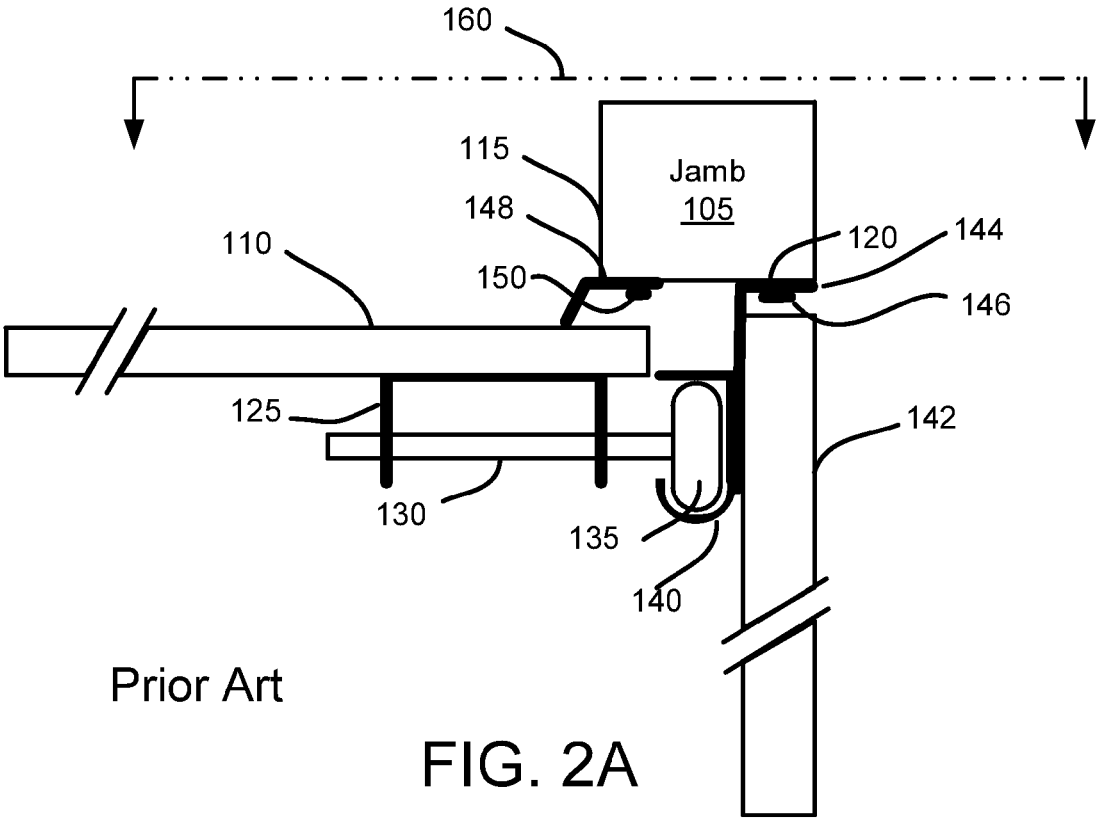
Prior Art FIG. 2A
FIG. 2A is a top view drawing illustrating one embodiment of a section and jamb.

FIG. 2A is a top view drawing illustrating one embodiment of a section 110 and a jamb 105. The section 110 and jamb 105 may be the cross section 160 of the section door 100 of FIG. 1. The section 110 and the jamb 105 are the section 110 and the jamb 105 of FIG. 1. The section 110 may be connected to a bracket 125. The bracket 125 may secure an axle 130 for a wheel 135. The wheel 135 may move within a track 140. In the depicted embodiment, the track 140 is connected to a jamb angle 144. The jamb angle 144 is secured to a jamb interior face 120 of the jamb 105 by a track fastener 146. The track fastener 146 may be a bolt, a wood screw, or the like. The sectional door 100 may be opened and closed as the sections 110 are moved along the track 140. The jamb 105 includes a jamb traverse face 115 and the jamb interior face 120.

In the past, a door seal 148 has been fastened directly to the jamb interior face 120 with a wood screw 150 or the like. Unfortunately, positioning the lengthy door seal 148 along the jamb interior face 120 and then securing the door seal 148 often results in uneven contact of the door seal 148 with the jamb interior face 120, and in breaks in the seal. For example, the door seal 148 may separate from the jamb interior face 120 because the wood screws 150 are placed too closely together relative a length of the door seal 148 between the wood screws 150. In addition, the door seal 148 may not be applied vertically plumb, reducing the effectiveness and visual attractiveness of the resulting seal.

Figure 2B:
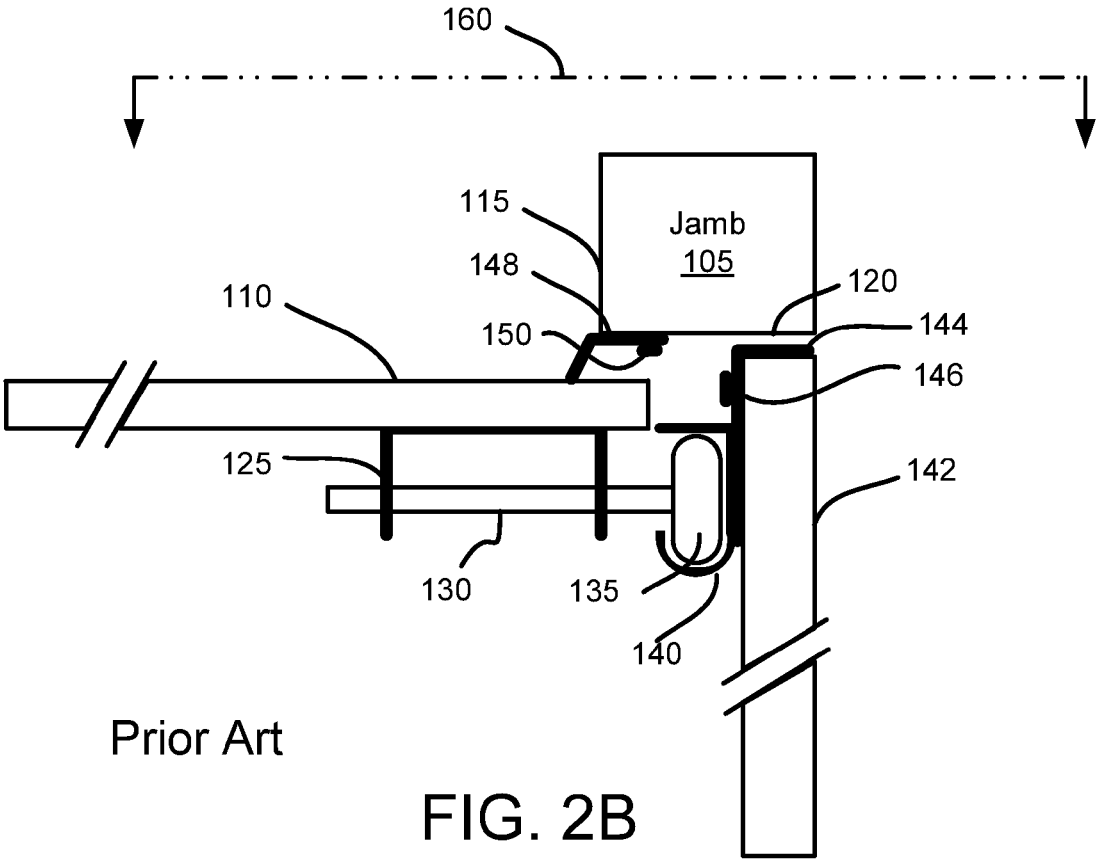
Prior Art FIG. 2B
FIG. 2B is a top view drawing illustrating one alternate embodiment of a section and jamb.

FIG. 2B is a top view drawing illustrating one alternate embodiment of a section 110 and a jamb 105. The section 110 and jamb 105 may be the cross section 160 of the section door 100 of FIG. 1. In the depicted embodiment, the track 140 is secured to the horizontal reinforcing angle 142 by the track fastener 146. Alternatively, the track 140 may be secured to a post.

The embodiments described herein allow an under-track door seal to be applied under the jamb angle 144 and to be secured by the track fastener 146. An installer need only loosen the track fastener 146 and insert the under-track door seal to a side of the jamb angle 144. The track fastener 146 is then retightened and under-track door seal may be held in place by the track fastener 146. As a result, the under-track door seal is more rapidly and accurately installed.

In addition, the embodiments may form a seal between one or more sections 110 and the lintel 107. For simplicity, both the jamb 105 and the lintel 107 are referred to as the jamb 105. One of skill in the art will recognize that the embodiments may be applied to both the vertical jamb 105 and the horizontal lintel 107.

Figure 2C:
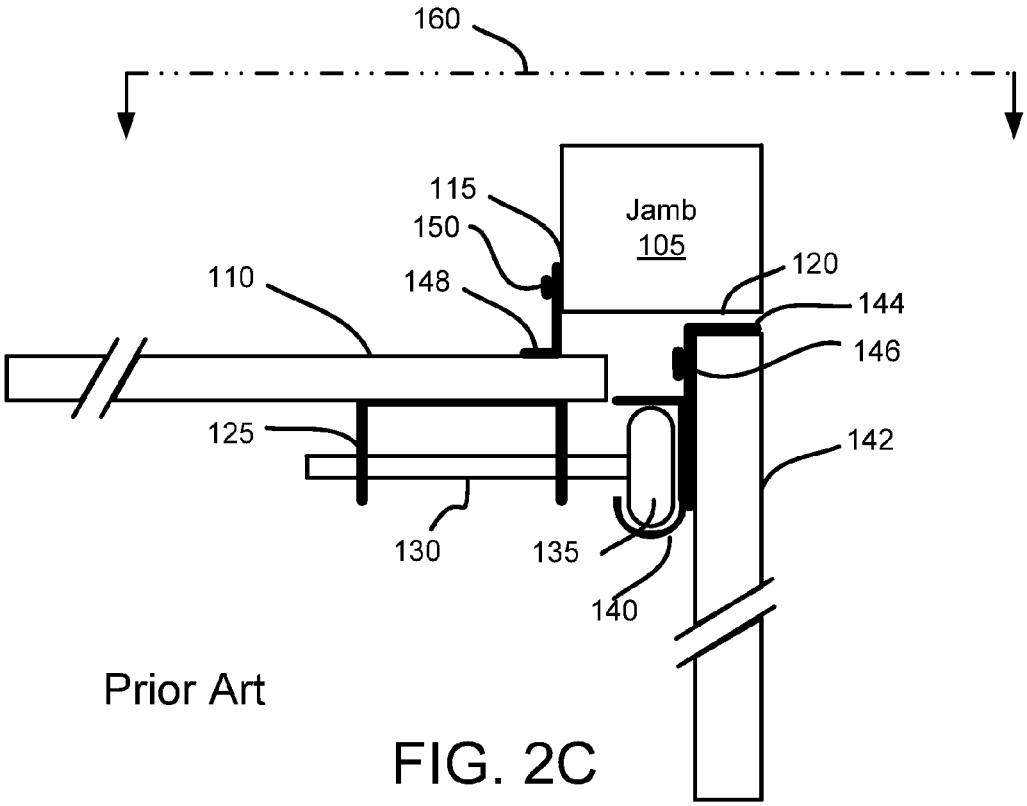
Prior Art FIG. 2C
FIG. 2C is a top view drawing illustrating one alternate embodiment of a section and jamb.

FIG. 2C is a top view drawing illustrating one alternate embodiment of a section 110 and a jamb 105. In the depicted embodiment, the door seal 148 is disposed on the jamb traverse face 115.

Figure 3A:
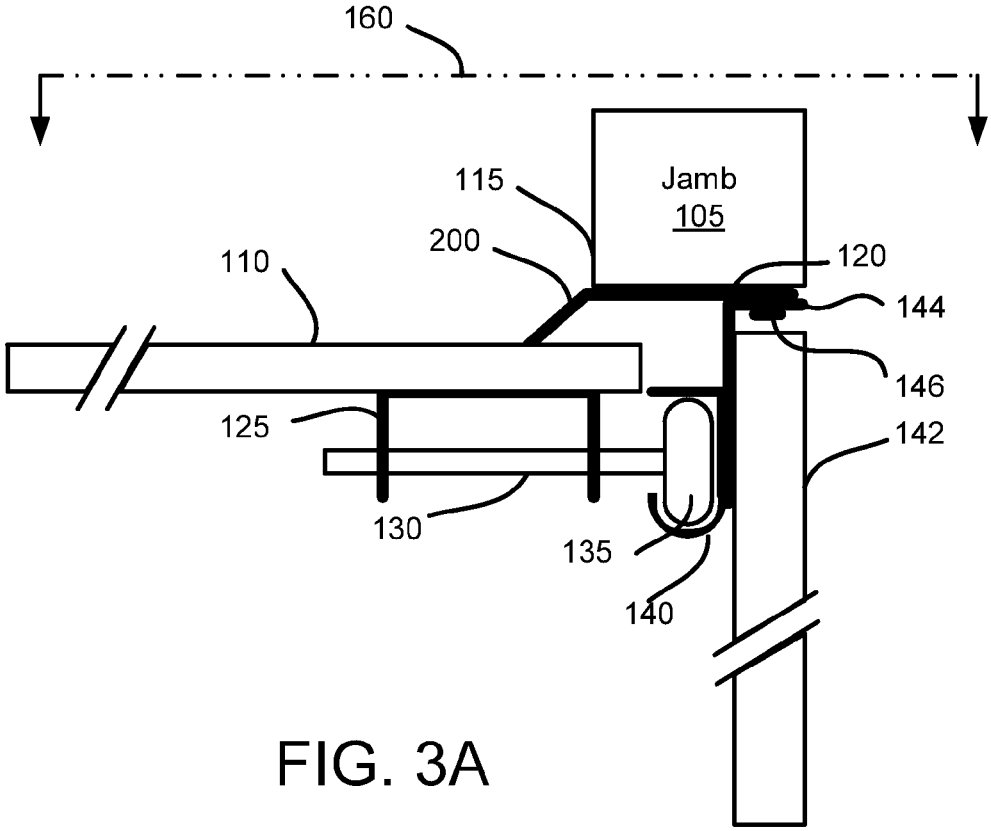
FIG. 3A is a top view drawing illustrating one embodiment of a section and jamb with door seal.

FIG. 3A is a top view drawing illustrating one embodiment of a section 110 and jamb 105 with an under-track door seal 200. The section 110 and jamb 105 may be the cross section 160 of the section door 100 of FIG. 1. The jamb angle 144 is positioned like the jamb angle 144 in FIG. 2A. In the depicted embodiment, the under-track door seal 200 is shown forming a seal between the jamb 105 and the section 110. The under-track door seal 200 may be installed by loosening the track fastener 146 and sliding the under-track door seal 200 between the jamb interior face 120 and the jamb angle 144. The track fastener 146 is then tightened to secure the under-track door seal 200 in place.

One of skill in the art will recognize that the under-track door seal 200 may form a seal between multiple sections 110 and the jamb 105. Alternatively, the under-track door seal 200 may form a seal between one or more sections 110 and the lintel 107. The under-track door seal 200 connects to the jamb interior face 120 along a longitudinal axis of the jamb interior face 120.

In addition to forming a seal between the sectional door 100 and the jamb 105, the under-track door seal 200 separates the jamb angle 144 from the jamb 105, forming a thermal break between the sectional door 100 and walls connected to the jamb 105.

Figure 3B:
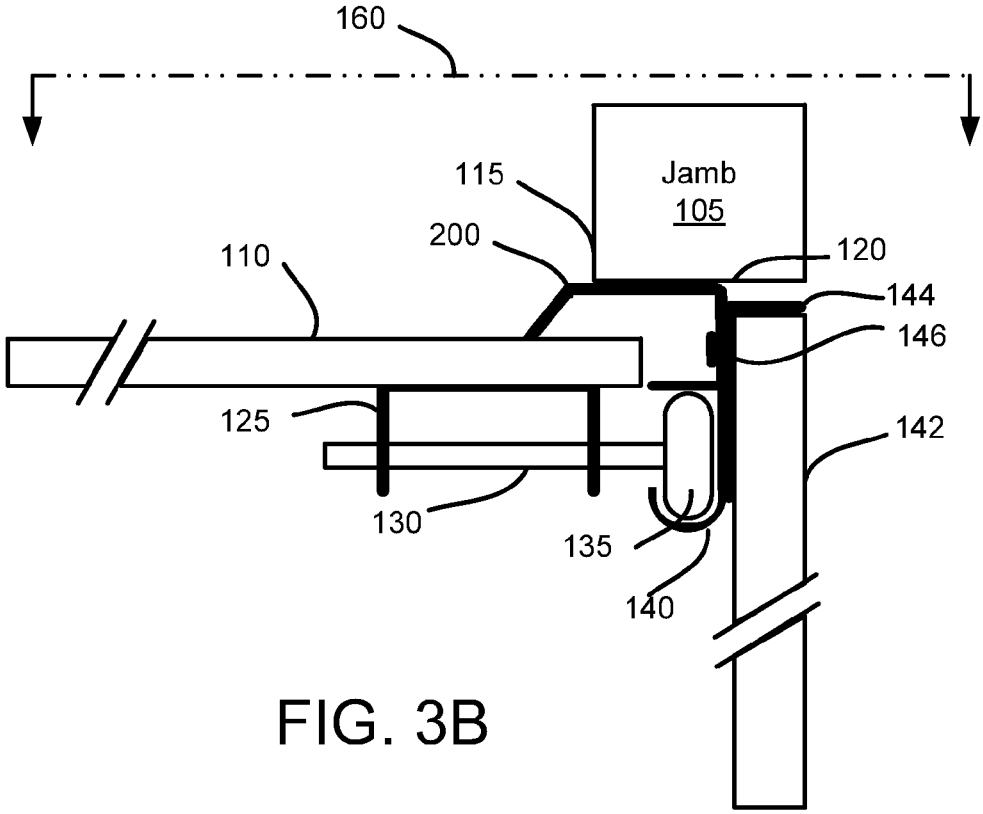
FIG. 3B is a top view drawing illustrating one alternate embodiment of a section and jamb with door seal.

FIG. 3B is a top view drawing illustrating one embodiment of a section 110 and jamb 105 with an under-track door seal 200. The section 110 and jamb 105 may be the cross section 160 of the section door 100 of FIG. 1. The jamb angle 144 is positioned like the jamb angle 144 in FIG. 2B. In the depicted embodiment, the track fastener 146 is loosened to allow a wall flange of the under-track door seal 200 to be slid between a track fastener head and the jamb angle 144. The track fastener 146 may be tightened to hold the under-track door seal 200 in place.

Figure 4:
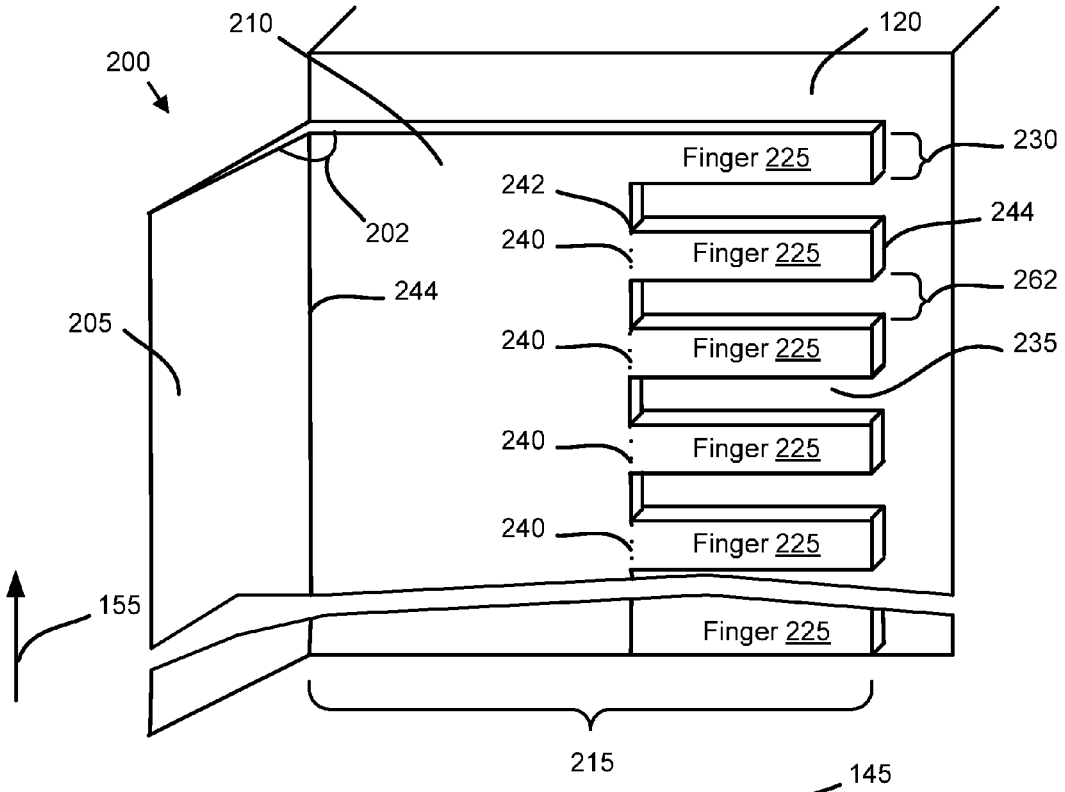
FIG. 4 is a perspective view drawing illustrating one embodiment of a door seal.

FIG. 4 is a perspective view drawing illustrating one embodiment of the under-track door seal 200. The under-track door seal 200 is depicted connected to the jamb interior face 120 along the latitudinal axis 155 of the jamb interior face 120. The under-track door seal 200 includes a jamb interface 210 and a flap 205. The flap 205 and the jamb interface 210 may be formed of an elastomer. In one embodiment, the jamb interface 210 and the flap 205 are extruded as a single piece.

The jamb interface 210 may be in physical communication with the jamb interior face 120 along a longitudinal axis 155 of the jamb interior face 120. The jamb interface 210 may be slid between the jamb angle 144 and the jamb interior face 120 after the track fastener 146 is loosened.

The jamb interface 210 may have a specified width 215 along a latitudinal axis 145. In one embodiment, the specified width is in the range of 9 to 14 centimeter (cm). In a certain embodiment, the specified width is in the range of 4 inches to 5.5 inches. In one embodiment, a roughness Ra of the surface of the jamb interface 210 that connects to the jamb interior face 120 is in the range 50,000 to 100,000 micro inches.

The flap 205 is disposed at an angle 202 to the jamb interface 210. In one embodiment, the angle 202 is in the range of 110° to 150°. The flap 205 may be flexible. As a result, the flap 205 may bend when the flap 205 contacts the section 110 and forms a seal, increasing the angle 202. By connecting to the jamb interior face 120, the under-track door seal 200 improves the seal between the jamb 105 and the section 110. In addition, the under-track door seal 200*a* is less susceptible to damage.

A plurality of fingers 225 are formed in the jamb interface 210. Each finger 225 may have a specified finger height 230. In addition, each finger 225 may be separated from adjacent fingers 225 by a specified spacing height 262. In one embodiment, the specified finger height 230 is in the range of 1 to 1.5 cm and the specified spacing height 262 is in the range of 1 to 1.5 cm. In a certain embodiment, the specified finger height 230 is 1.2446 cm and the specified spacing height 262 is 1.2954 cm.

The finger spacing 235 accommodates ⅜ inch diameter lag bolts that are typically used as track fasteners 146. In addition, the specified spacing height 262 and specified finger height 230 accommodate the vertical spacing of the track fasteners 146 in a typical track 140 installation.

A proximal edge 242 of the finger 225 may be in the range of 4 to 6.5 cm along the latitudinal axis 145 from an intersection 244 of the flap 205 and the jamb interface 210. A distal edge 244 of the finger 225 may be in the range of 4 to 6.5 cm along the latitudinal axis 145 from the proximal edge 242.

The specified width 215, specified finger height 230, specified spacing height 262, and distance from the proximal edge 242 to the intersection 244 are selected to be compatible with almost all sectional door 100 installations in the last 75 years. As a result, the under-track door seal 200 may be installed in easily and quickly with any make and model of sectional door 100.

In one embodiment, one or more of the fingers 225 are scored 240 at the proximal edge 242. The scoring 240 may be an indentation, a groove, or the like. The scoring 240 may be to a depth of 0.079375 cm. In one embodiment, when the finger 225 is bent at the score 240, the finger 225 may be separated from the jamb interface 210 to allow a track fastener 146 to fit within the fingers 225.

Figure 5:
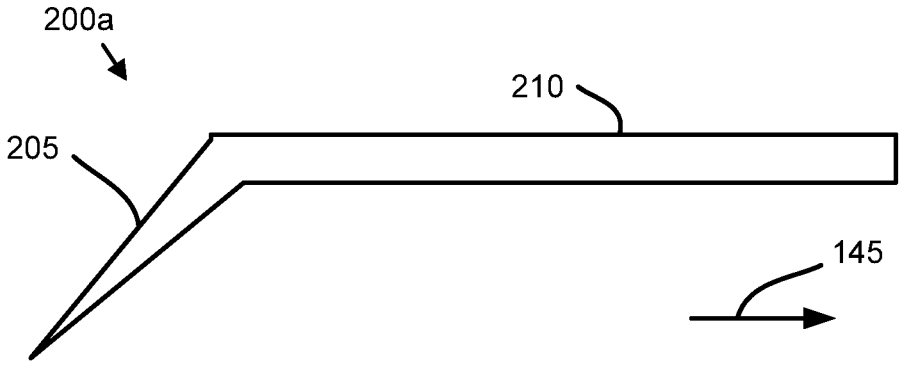
FIG. 5 is a top view drawing illustrating one embodiment of a door seal.

FIG. 5 is a top view drawing illustrating one embodiment of an under-track door seal 200*a*. The under-track door seal 200*a* is the under-track door seal 200*a* of FIG. 4. The flap 205 and the jamb interface 210 are shown.

Figure 6:
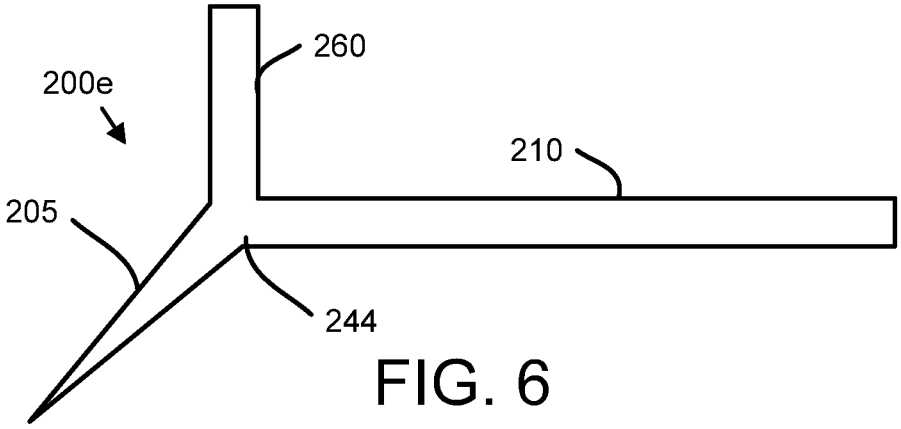
FIG. 6 is a top view drawing illustrating one alternate embodiment of a door seal.

FIG. 6 is a top view drawing illustrating one alternate embodiment of an under-track door seal 200*e*. The under-track door seal 200*e* is depicted with a jamb flange 260. The jamb flange 260 is disposed at the intersection 244 of the flap 205 and the jamb interface 210. The jamb flange 260 may be orthogonal to the latitudinal axis 145 and the longitudinal axis 155, and abut the jamb traverse face 115 of the jamb 105. The jamb flange 260 may be extruded as a single piece with the flap 205 and the jamb interface 210. In one embodiment, the jamb flange 260 extends the seal between the section 110 and the jamb 105.

Figure 7:
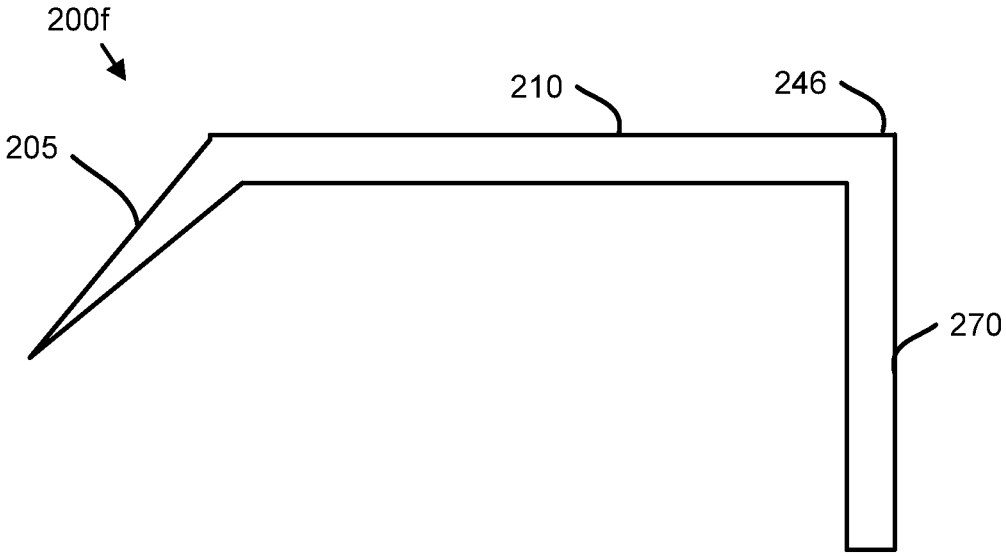
FIG. 7 is a top view drawing illustrating one alternate embodiment of a door seal.

FIG. 7 is a top view drawing illustrating one alternate embodiment of an under-track door seal 200*f*. The under-track door seal 200*f* is depicted with a wall flange 270. The wall flange 270 may be disposed at a distal edge 246 of the jamb interface 210. In one embodiment, the wall flange 270 is orthogonal to the latitudinal axis 145 and orthogonal to the longitudinal axis 155 of the jamb interior face 120. In addition, the wall flange 270 may be in physical communication with the lintel 270.

Figure 8:
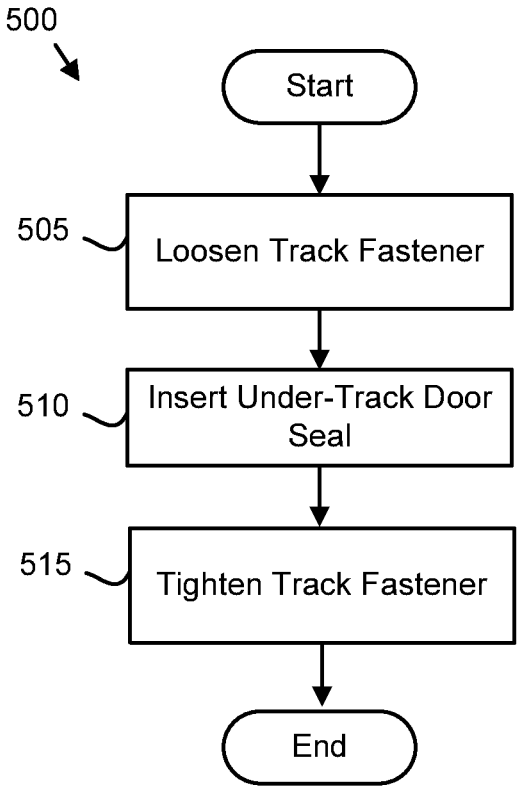
FIG. 8 is a schematic flow chart diagram illustrating one embodiment of a door seal method.

FIG. 8 is a schematic flow chart diagram illustrating one embodiment of a door seal method 500. The method 500 may perform the functions of the under-track door seal 200 of FIGS. 1-10. The method 500 starts and the track fastener 146 may be loosened 505. The under-track door seal 200 may be inserted 510 so that the fingers 225 of the under-track door seal 200 may be positioned on either side of the track fastener 146 so that the track fastener 146 is within the finger spacing 235. The jamb interface 210 is in physical communications with the jamb interior face 120 of the jamb 105 along the longitudinal axis 155 of the jamb interior face 120. The flap 205 seals between the section door 100 and the jamb 105. The track fastener 146 may be tightened 515 to secure the under-track door seal 200 in place relative to the jamb 105 and the method 500 ends.

Because the fingers 225 allow the track fastener 146 to be positioned within the finger spacing 235, the under-track door seal 200 may be quickly and accurately positioned relative to the jamb 105 by an installer. As a result, installation is more rapid and results in reduced seal leaks.

The embodiments may be practiced in other specific forms. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. An apparatus comprising:

a jamb interface with a width connecting to a jamb interior face of a jamb along a vertical longitudinal axis of the jamb interior face, the jamb interface comprising a plurality of fingers with a proximal edge of each of the fingers extending in a range of 4 to 6.5 centimeters (cm) from an intersection of the jamb interface and a flap, each finger having a longitudinal axis extending parallel to each other, each finger having a finger height along the vertical longitudinal axis in a range of 1 to 1.5 cm and a finger length along each finger longitudinal axis in the range of 4 to 6.5 cm, wherein each finger is the same finger length, and each finger is separted from adjacent fingers by a spacing height in the range of 1 to 1.5 cm, and the plurality of fingers do no contact a section door; and the flap forming a seal between the section door and the jamb.

2. The apparatus of claim 1, wherein the proximal edge of the fingers is 5.08 cm from the intersection of the jamb interface and the flap, the finger height is 1.2446 cm, and the spacing height is 1.2954 cm.

3. The apparatus of claim 1, wherein the width is in a range of 9 to 14 cm.

4. The apparatus of claim 1, further comprising a jamb flange disposed at an intersection of the flap and the jamb interface, the jamb flange orthogonal to a latitudinal axis and the longitudinal axis of the jamb interior face, and abutting a jamb traverse face of the jamb.

5. The apparatus of claim 1, wherein the flap and the jamb interface are extruded as a single piece.

6. The apparatus of claim 1, wherein the flap and jamb interface are formed of an elastomer.

7. The apparatus of claim 1, wherein the proximal edge of one or more of the plurality of fingers is scored.

8. The apparatus of claim 7, wherein each finger is scored to a depth of 0.079375 cm.

9. A system comprising:

a section door;

a jamb comprising a jamb interior face;

a jamb interface with a width connecting to the jamb interior face along a vertical longitudinal axis of the jamb interior face, the jamb interface comprising a plurality of fingers with a proximal edge of each of the fingers extending in a range of 4 to 6.5 centimeters from an intersection of the jamb interface and a flap, each finger having a longitudinal axis extending parallel to each other, each finger having a finger height along the vertical longitudinal axis in a range of 1 to 1.5 centimeters and a finger length along each finger longitudinal axis in the range of 4 to 6.5 cm wherein each finger is the same length, and each finger is separated from adjacent fingers by a spacing height in the range of 1 to 1.5 cm, and the plurality of fingers do no contact the section door; and the flap forming a seal between the section door and the jamb.

* * * * *